US005217684A

United States Patent [19]

Igarashi et al.

[11] Patent Number: 5,217,684

[45] Date of Patent: * Jun. 8, 1993

[54] PRECIPITATION-HARDENING-TYPE NI-BASE ALLOY EXHIBITING IMPROVED CORROSION RESISTANCE

[75] Inventors: Masaaki Igarashi, Amagasaki; Shiro Mukai, Tokyo; Yasutaka Okada, Amagasaki; Akio Ikeda, Osaka, all of Japan

[73] Assignee: Sumitomo Metal Industries, Ltd., Osaka, Japan

[ * ] Notice: The portion of the term of this patent subsequent to Mar. 19, 2008 has been disclaimed.

[21] Appl. No.: 619,980

[22] Filed: Nov. 30, 1990

Related U.S. Application Data

[63] Continuation-in-part of Ser. No. 123,878, Nov. 23, 1987, Pat. No. 5,000,914.

[30] Foreign Application Priority Data

Nov. 28, 1986 [JP] Japan ..... 61-283671
Dec. 3, 1986 [JP] Japan ..... 61-288282

[51] Int. Cl.[5] ..... C22C 19/05

[52] U.S. Cl. ..... 420/448; 148/410; 148/428; 420/443; 420/451

[58] Field of Search ..... 420/443, 448, 451, 582, 420/584, 586; 148/410, 419, 427, 428, 442, 158, 162

[56] References Cited

U.S. PATENT DOCUMENTS 3,046,108 7/1962 Eiselstein ..... 420/448
4,245,698 1/1981 Berkowitz et al. ..... 166/244
4,358,511 11/1982 Smith et al. ..... 428/595
4,400,210 8/1983 Kudo et al. ..... 420/443
4,400,211 8/1983 Kudo et al. ..... 420/443
4,652,315 3/1987 Igarashi et al. ..... 148/12.7
4,731,117 3/1988 Stulga et al. ..... 75/243
4,788,036 11/1988 Eiselstein et al. ..... 148/442
5,000,914 3/1991 Igarashi et al. ..... 420/451

FOREIGN PATENT DOCUMENTS 59-083739 5/1984 Japan .
61-142672 6/1986 Japan .
61-034498 8/1986 Japan .

OTHER PUBLICATIONS

Frank et al. "A New Age-Hardenable Corrosion-Resistant Alloy"; ASM Materials Conference Dec. 1986.

*Primary Examiner*—John P. Sheehan
*Assistant Examiner*—Margery S. Phipps
*Attorney, Agent, or Firm*—Burns, Doane, Swecker & Mathis

[57] ABSTRACT

A precipitation-hardening-type Ni-base alloy exhibiting improved resistance to stress corrosion cracking in a sour gas atmosphere containing elemental sulfur at high temperatures is disclosed. The alloy consists essentially of, by weight %;

| | | | |
|---|---|---|---|
| Cr: | 12–25%, | Mo: | over 9.0 and up to 15%, |
| Nb: | 4.0–6.0%, | Fe: | 5.0–25%, |
| Ni: | 45–60%, | C: | 0.050% or less, |
| Si: | 0.50% or less, | Mn: | 1.0% or less, |
| P: | 0.025% or less, | S: | 0.0050% or less, |
| N: | 0.050% or less, | | |
| Ti: | 0.46–1.0%, | Al: | 0–2.0%. |

15 Claims, No Drawings

PRECIPITATION-HARDENING-TYPE NI-BASE ALLOY EXHIBITING IMPROVED CORROSION RESISTANCE

This application is a continuation-in-part of Ser. No. 07/123,878 filed on Nov. 23, 1987, now U.S. Pat. No. 5,000,914.

The present invention relates to Ni-base alloys of the precipitation-hardening type which exhibit improved corrosion resistance. The alloys are especially useful for oil well tubular goods, particularly members for fabricating oil well outlet assemblies, oil well bottom casings, and the like which must have improved resistance to stress corrosion cracking and hydrogen embrittlement in a corrosive environment which contains sulfur, not in the form of sulfides such as FeS and NiS, but in the elemental form in an atmosphere containing a sour gas, i.e., an atmosphere containing $H_2S$—$CO_2$—Cl— (hereinafter called a "sour gas atmosphere").

Recently, wells for producing oil, natural gas, and geothermal hot water are being drilled deeper and deeper in sour gas atmospheres. These wells are hereinunder collectively referred to simply as oil wells. Under such severe corrosive conditions, high-strength and highly corrosion-resistant materials such as Ni-base alloys have been employed. Since the corrosion resistance of these Ni-base alloys is improved by increasing the content of Cr, Mo, and W, an alloy suitable for application in particularly corrosive conditions is designed by taking this into account. A strength of 77 $kgf/mm^2$ or more, or 91 $kgf/mm^2$ or more at an offset of 0.2% is required of such alloys. Therefore, the strength of tubular goods including tubing, casing and liners is improved by cold working. On the other hand, for articles such as oil well outlet assemblies and oil well bottom casing members to which bending, i.e., cold working cannot be applied, the strength thereof is improved by means of the precipitation of $\gamma'$ or $\Gamma''$ intermetallic compounds.

Newly-developed oil wells sometimes encounter corrosive environments which contain elemental sulfur, i.e., not in the form of sulfides in a sour gas atmosphere. In such corrosive conditions, conventional Ni-base alloys which are designed to be used in sour gas atmospheres do not exhibit a sufficient degree of corrosion resistance.

In a corrosive environment in which both $H_2S$—$CO_2$—Cl— and elemental sulfur are contained, Ni-alloys exhibit a unique corrosion-resistant behavior. The inventors of the present invention have already proposed corrosion-resistant alloys which exhibit a satisfactory level of corrosion resistance under such corrosive conditions, and which are useful for members such as tubing, casing, liners, and the like which require cold working for improving strength. See Japanese Patent Applications Nos. 61-1199 and 61-1204.

However, when such alloys are used as oil well outlet assembly members and bottom casing members which cannot be subjected to cold working, the strength thereof must be improved by means of precipitation hardening of $\gamma'$ or $\gamma''$ intermetallic compounds. The conventional alloys of this type easily suffer from local corrosion or stress corrosion cracking (hereunder referred to as "SCC") in a sour gas atmosphere containing elemental sulfur. The elemental sulfur forms the three phases Sx-1, $H_2S$, and $H_2Sx$, depending on the temperature and pressure (particularly the $H_2S$ partial pressure) in accordance with the reaction ($Sx\text{-}1 + H_2S \rightleftarrows H_2Sx$). If free sulfur such as Sx-1 or $H_2Sx$ is present, it deposits on a limited area of an oil well inlet assembly or bottom casing, causing pitting or SCC. This is because the concentration of $H_2S$ is increased locally in accordance with the reaction $4S + 4H_2S \rightleftarrows 3H_2 + H_2SO_4$, and because the formation of $H_2SO_4$ lowers the pH value. In order to achieve a satisfactory level of corrosion resistance under such unique corrosive conditions, it is necessary to provide a strong and easily recoverable corrosion-resistant film on the members for oil-well inlet assembly and bottom casing made of precipitation-hardening alloys. Conventional precipitation-hardening-type Ni-base alloys, however, have limitations regarding alloying elements, because precipitation hardenability should be maintained and precipitation of unstable phases such as a sigma phase or a Laves phase should be avoided. A precipitated phase should be limited to a $\gamma'$ or $\gamma''$ phase, which is metastable. Thus, so long as the conventional alloy is used, a satisfactory level of corrosion resistance could not be obtained under such severe corrosive conditions.

The object of the present invention is to provide high strength precipitation-hardening Ni-base alloys which can exhibit a satisfactory level of resistance to stress corrosion cracking as well as hydrogen embrittlement fracture in an environment containing elemental sulfur in addition to $H_2S$—$CO_2$—Cl—.

The present inventors have carried out a series of experiments to obtain an alloy system which exhibits improved strength and has an easily restored film on its surface without adversely affecting precipitation hardenability. Such corrosion resistance in a sour gas atmosphere is further improved by the addition of Cr, Mo, and W for the case in which cold working can be applied to produce tubular goods. When the atmosphere contains elemental sulfur, the addition of Nb is effective. On the basis of these findings, the inventors carried out another series of experiments, as a result of which the following was learned.

(1) In case a precipitation-hardening Ni-base alloy is prepared for manufacturing tubular goods for an oil well outlet assembly and bottom casing, the addition of large amounts of Cr, Mo, and W results in the formation of fragile phases, such as a sigma-phase and a Laves phase in the final product. These phases adversely affect the precipitation hardening of $\gamma'$ or $\gamma''$ phase. Furthermore, the addition of these elements is not effective for improving the strength and restorability of the film.

(2) Further studying the mechanism in which the addition of these elements can improve the resistance to corrosion, the inventors of the present invention have found that a specific combination containing 5.5–15% Mo and 4.0–6.0% Nb markedly improves high-temperature strength as well as film-restorability, resulting in a satisfactory level of resistance to SCC as well as hydrogen embrittlement in a corrosive environment, including one which contains elemental sulfur at 200° C. to 250° C. or at 200° C. or lower, the improvement being achieved by prohibiting a decrease in $\gamma'$ and $\gamma''$ intermetallic compounds, thereby improving precipitation hardenability.

Thus, the present invention resides in a precipitation-hardening-type Ni-base alloy exhibiting improved resistance to stress corrosion cracking in a sour gas atmosphere containing elemental sulfur at high temperatures, which comprises essentially, by weight %;

| | |
|---|---|
| Cr: 12–25%, | Mo: 5.5–15%, |
| Nb: 4.0–6.0%, | Fe: 5.0–25%, |
| Ni: 45–60%, | C: 0.050% or less, |
| Si: 0.50% or less, | Mn: 1.0% or less, |
| P: 0.025% or less, | S: 0.0050% or less, |
| N: 0.050% or less, | |
| Ti: 0–1.0%, | sol.Al: 0–2.0%. |

In another aspect, the present invention resides in a method of improving the resistance of tubular goods for oil wells to stress corrosion cracking in a sour gas atmosphere containing elemental sulfur at high temperatures by means of fabricating the goods of a precipitation-hardening-type Ni-base alloy comprising the above alloy composition. Preferably, in a sour gas atmosphere containing elemental sulfur at a temperature 200–250° C., the alloy composition comprises essentially, by weight %;

| | |
|---|---|
| Cr: 12–22%, | Mo: 9.0–15%, |
| Nb: 4.0–6.0%, | Fe: 5.0–20%, |
| Ni: 50–60%, | C: 0.050% or less, |
| Si: 0.50% or less, | Mn: 1.0% or less, |
| P: 0.025% or less, | S: 0.0050% or less, |
| N: 0.050% or less, | |
| Ti: 0–1.0%, | sol.Al: 0–2.0%. |

In a preferred embodiment, when the alloy composition is further defined by the following Equation (1), the resulting structure is stabilized to provide a homogeneous alloy which has improved hot workability. The alloy also exhibits improved resistance to SCC.

$$Ni-2\{Mo-1.5(Cr-12)\}-3\{Nb-1.5Ti-05(Al0.5)\}\geqq 0 \quad (1)$$

In a further preferred embodiment, when the molybdenum content is 9.0%–15% and the following Equation (2) is satisfied, the resulting structure is stabilized to provide a homogeneous alloy which has improved hot workability. The alloy also exhibits improved resistance to SCC.

$$Ni-2\{Mo+1.5(Cr-12)\}-4\{Nb+1.5Ti+0.5(Al-0.5)\}\geqq 0 \quad (2)$$

Therefore, according to the present invention, Ni-base alloys of the precipitation-hardening type can be obtained; these alloys can exhibit improved resistance to SCC as well as hydrogen embrittlement at a temperature of 200° C. or higher, such as in a sour gas atmosphere containing elemental sulfur when the Mo content is 9.0% or higher.

The reasons why the alloy composition of the present invention is defined in the above manner will now be described in detail.

Chromium (Cr)

Chromium forms an austenitic matrix phase together with Mo, Ni, Fe, and the like. This matrix is effective for carrying out precipitation hardening. It has been thought in the past that the addition of Cr is effective for improving corrosion resistance at high temperatures in a sour gas atmosphere. The inventors found that Cr is effective together with Mo and Ni for improving the strength of the corrosion-resistant film. For this purpose, the Cr content should be 12% or more. The upper limit is set at 25%, preferably 22% in order to stabilize the microstructural structure.

Molybdenum (Mo)

Molybdenum in an amount of 5.5%–15% is essential so as to form a corrosion-resistant film which is corrosion resistant under the above-mentioned environment at high temperatures. Assuming that the service temperature is 200°–250° C., the Mo content should be 9.0% or more. On the other hand, the addition of too much Mo produces a sigma-phase and a Laves phase which prohibit the precipitation of $\gamma'$ and $\gamma''$ intermetallic compounds with a reduction in hot workability. Therefore, in the present invention, the Mo content is not larger than 15%. When the service temperature is 200° C. or lower, the Mo content may be 5.5%–9.0%.

It is generally recognized that tungsten is equivalent to Mo. Usually it is thought that 1% of Mo is equal to 2% of W in view of its atomic weight. However, according to the present invention, it is impossible from a practical view point to incorporate a relatively large amount of W. Needless to say, part of the Mo may be replaced by W.

Nickel (Ni)

Ni is necessary to effect precipitation hardening. It also has an advantageous effect on the strength of the corrosion-resistant film in the above-mentioned atmosphere. For this purpose, the Ni content should be at least 45%, preferably at least 50%, and the upper limit of the Ni content may be 60% in view of the improvement in resistance to hydrogen embrittlement.

Iron (Fe)

The addition of Fe is necessary to improve precipitation hardenability caused by the precipitation of $\gamma'$ and $\gamma''$ intermetallic compounds. For this purpose, an Fe content of 5.0% or more is necessary, and the upper limit thereof is defined as 25%, preferably 20% in view of the content of the other alloying elements.

Niobium (Nb)

Nb is effective for promoting precipitation of $\gamma''$-$Ni_3Nb$ ($DO_{22}$-type ordered structure) in the alloy system of the present invention, resulting in improvement in strength as well as resistance to corrosion. This is because stress concentrations are reduced due to a unique deformation mechanism of the above $\gamma''$ and also because the $\gamma''$ exhibits improved resistance to pitting corrosion. When a Nb content is less than 4.0%, the alloy does not obtain enough strength for this purpose by the precipitation hardening treatment. A Nb content of 4.0% or more is necessary for this purpose. However, an excess amount of Nb results in a undesirable second phase, such as a Laves phase, and the upper limit thereof is accordingly 6.0%.

Titanium (Ti)

When much titanium is added, the $\gamma'$-phase forms. The $\gamma'$-phase $Ni_3$ (Ti, Al) increases the sensitivity to SCC and hydrogen embrittlement. However, in the alloy system of the present invention, when a small amount thereof is added, the precipitation of the $\gamma''$ phase is promoted. Therefore, when added, the upper limit is restricted to 1.0%. On the other hand, in order to obtain such an effect, it is necessary to add Ti in an amount of 0.01% or more.

Aluminum (Al)

When added in an amount of 0.5% or less, Al is effective as a deoxidizing agent. Al is also effective for stabilizing the structure. For the purpose of obtaining such effects, it is necessary to add Al in an amount of 0.01% or more. The addition of Al is also effective to promote the precipitation of the $\gamma'$ and $\gamma''$ phases. 0.5% or more of Al may be added, but Al in an amount of larger than 2.0% is not desirable from the viewpoint of improving strength.

Carbon (C)

When added in an amount of larger than 0.050%, a coarse MC type carbide (M: Nb or Ti) forms, markedly decreasing ductility and toughness. Therefore, it is preferable to restrict the carbon content to not higher than 0.020%.

Silicon and Manganese (Si, Mn)

Si and Mn are usually effective as a deoxidizing agent or desulfurizing agent. However, when too much is added, a decrease in ductility as well as toughness is inevitable. Therefore, when they are added, the upper limits are restricted to 0.50% for Si and 1.0% for Mn.

Phosphorus and Sulfur (P, S)

P and S are impurities which are inevitably included in the alloy. When they are present in large quantities, hot workability and corrosion resistance are adversely affected. The upper limits thereof are restricted to 0.025% and 0.0050%, respectively.

Nitrogen (N)

When a large amount of nitrogen is added, it forms an MN-type nitride (M: Nb, Ti) which prevents the precipitation of $\gamma'$ and $\gamma''$ intermetallic compounds, resulting in much deterioration in ductility and toughness. Therefore, the upper limit of N is restricted to 0.050%.

In a preferred embodiment, the alloy composition of the present invention is preferably restricted in accordance with Equation (1). Such a further restricted alloy composition can further improve hot workability, resulting in a more homogeneous metallurgical structure with synergistically improved corrosion resistance, such as the resistance to SCC.

In a further preferred embodiment, Equation (2) is satisfied for the alloy containing 9.0%-15% of Mo.

According to the present invention, the following elements can be added as optional elements.

Copper may be added to facilitate the formation of a corrosion-resistant film in the above-mentioned atmosphere. However, an excess amount of Cu adversely affects the precipitation hardening caused by the precipitation of the $\gamma'$ and $\gamma''$ compounds. It is preferable to limit the Cu content to 2.0% or less, when Cu is added.

Co may be added to further improve the resistance to hydrogen embrittlement. The higher the Co content the lower is the toughness. Therefore, it is preferable to limit the Co content to 5.0% or less, when Co is added.

At least one of REM, Mg, Ca, and Y may be added so as to improve hot workability. When REM, Mg, Ca and Y are added in amounts over 0.10%, 0.10%, 0.10%, 0.20%, respectively, low-melting point compounds easily form. Therefore, the upper limits thereof are restricted to 0.10%, 0.10%, 0.10%, and 0.20%, respectively.

Other alloying elements such as V, Zr, Ta, and Hf are also effective to stabilize the metallurgical structure, and a total amount of up to 2.0% of these elements may be added to the alloy of the present invention. Furthermore, the presence of impurities such as B, Sn, Zn, and Pb is allowed in a total amount of up to 0.10%.

The present invention will be further described in conjunction with some working examples, which are presented merely for the purposes of illustration.

EXAMPLE 1

Sample alloys whose chemical compositions are shown in Table 1 were prepared and subjected to hot working to obtain plates. The alloy plates were subjected to a solid solution treatment under the conditions described below and then were subjected to in a strength of 77 kgf/mm$^2$ at an offset of 0.2% at aging to obtain room temperature. Test pieces for the below-mentioned tests were cut from these specimens.

The test results are summarized in Table 2.

Tensile Test

Temperature: room temperature
Test Piece: 4.0 mm $\phi \times$ GL=20 mm
Strain Rate: $1\times10^{-3}$ s$-1$
Data Obtained: Tensile Strength, Elongation, Reduction in Area

Impact Test

Temperature: 0° C.
Test Piece: 10×10×55 mm−2.0 mmV notch
Data Obtained: Impact Energy

SCC Test

Solution: 20%NaCl−1.0 g/l S−10 atm $H_2S$ −20 atm $CO_2$
Temperature: 250° C.
Soaking Time: 500 hours
Test Piece: 2t×10w×751 (mm)
U notch (R: 0.25) (mm)
Applied Stress
Prestress: 1.0 $\sigma$y

Hydrogen Embrittlement Test

NACE Condition: 5%NaCl−0.5%$CH_3COOH$−1 atm $H_2S$ 25° C.
Test Piece: Carbon Steel Coupling
2t×20w×751 (mm)
U notch (R: 0.25) (mm)
Applied Stress: 1.0 $\sigma$y
Soaking Time: 1000 hours

EXAMPLE 2

In this example, Example 1 was repeated for alloys containing less than 9.0% of Mo except that the SCC test was carried out at 200° C.

Chemical compositions of sample alloys are shown in Table 3 and the test results are summarized in Table. 4.

Table 5 shows examples of alloy compositions within the scope of the invention having 0.50 to 1.00 wt. % Ti. Table 6 shows test results for the alloy compositions set forth in Table 5.

While the invention has been described with reference to the foregoing embodiments and examples, various changes and modifications could be made thereto which fall within the scope of the appended claims.

TABLE 1

| No. | Chemical Composition (% by weight) C | Si | Mn | P | S | Ni | Cr | Mo | Fe | Ti | Al | Nb | N | Remarks |
|---|---|---|---|---|---|---|---|---|---|---|---|---|---|---|
| 1 | 0.014 | 0.05 | 0.34 | 0.002 | 0.001 | 57.8 | 15.7 | 12.3 | 8.6 | <0.01 | 0.18 | 4.98 | 0.002 | Invention |
| 2 | 0.006 | 0.16 | 0.71 | 0.010 | 0.002 | 54.4 | 17.2 | 10.1 | 12.4 | <0.01 | 0.33 | 4.62 | 0.006 | Alloys |
| 3 | 0.031 | 0.01 | 0.02 | 0.001 | 0.001 | 56.5 | 14.8 | 11.7 | 11.9 | <0.01 | 0.06 | 4.88 | 0.004 | |
| 4 | 0.002 | 0.38 | 0.01 | 0.006 | 0.001 | 59.6 | 19.2 | 9.8 | 6.3 | <0.01 | 0.43 | 4.27 | 0.002 | |
| 5 | 0.010 | 0.06 | 0.32 | 0.002 | 0.003 | 52.4 | 13.2 | 14.7 | 12.2 | <0.01 | 0.18 | 4.79 | 0.012 | |
| 6 | 0.007 | 0.01 | 0.32 | 0.001 | 0.001 | 57.8 | 17.1 | 11.8 | 7.9 | 0.03 | 0.14 | 4.84 | 0.002 | |
| 7 | 0.003 | 0.02 | 0.30 | 0.001 | 0.001 | 58.1 | 14.9 | 11.4 | 9.6 | <0.01 | 0.07 | 5.57 | 0.003 | |
| 8 | 0.007 | 0.12 | 0.10 | 0.003 | 0.001 | 57.9 | 15.2 | 10.8 | 10.4 | 0.46 | 0.22 | 4.76 | 0.002 | |
| 9 | 0.003 | 0.18 | 0.10 | 0.002 | 0.001 | 55.7 | 15.1 | 11.2 | 11.3 | 0.09 | 1.02 | 4.96 | 0.004 | |
| 10 | 0.007 | 0.06 | 0.31 | 0.001 | 0.001 | 58.6 | 16.1 | 11.0 | 7.8 | <0.01 | 1.10 | 4.99 | 0.003 | |
| 11 | 0.006 | 0.05 | 0.10 | 0.002 | 0.001 | 58.0 | 18.3 | 9.1 | 8.7 | 0.21 | 0.76 | 4.74 | 0.002 | |
| 12 | 0.004 | 0.10 | 0.01 | 0.002 | 0.001 | 53.7 | 14.1 | 13.3 | 10.1 | <0.01 | 1.24 | 4.69 | 0.001 | |
| 13 | 0.003 | 0.07 | 0.01 | 0.002 | 0.001 | 59.7 | 20.2 | 9.1 | 6.5 | <0.01 | 0.12 | 4.19 | 0.002 | |
| 14 | 0.005 | 0.01 | 0.01 | 0.002 | 0.001 | 55.4 | 18.1 | 12.7 | 8.8 | 0.01 | 0.08 | 4.86 | 0.002 | |
| 15 | 0.008 | 0.01 | 0.30 | 0.010 | 0.001 | 52.7 | 16.4 | 10.6 | 14.7 | 0.46 | 0.12 | 4.66 | 0.001 | |
| 16 | 0.006 | 0.04 | 0.29 | 0.002 | 0.001 | 56.9 | 15.7 | 14.0 | 7.9 | 0.01 | 0.20 | 4.85 | 0.002 | |
| 17 | 0.003 | 0.10 | 0.10 | 0.002 | 0.001 | 62.9* | 21.1 | 9.2 | 2.7* | <0.01 | 0.23 | 3.65* | 0.001 | Comparative |
| 18 | 0.002 | 0.05 | 0.30 | 0.002 | 0.005 | 50.3 | 19.0 | 3.1* | 20.7 | 1.06* | 0.42 | 5.10 | 0.002 | Alloys |
| 19 | 0.013 | 0.01 | 0.01 | 0.002 | 0.001 | 42.1* | 21.8 | 3.0* | 28.0* | 2.4* | 0.30 | <0.001* | 0.002 | |
| 20 | 0.07* | 0.12 | 0.01 | 0.002 | 0.007* | 55.1 | 15.8 | 13.1 | 11.1 | 0.01 | 0.10 | 4.56 | 0.001 | |
| 21 | 0.011 | 0.64* | 0.01 | 0.030* | 0.001 | 52.4 | 18.6 | 10.8 | 11.2 | 0.72 | 0.35 | 5.12 | 0.002 | |
| 22 | 0.003 | 0.01 | 0.01 | 0.001 | 0.002 | 51.6 | 22.8* | 9.2 | 10.6 | 1.12* | 0.05 | 4.56 | 0.002 | |
| 23 | 0.006 | 0.02 | 0.01 | 0.002 | 0.001 | 62.7* | 20.9 | 8.4 | 2.1* | 0.01 | 0.52 | 5.33 | 0.001 | |
| 24 | 0.012 | 0.10 | 0.11 | 0.012 | 0.001 | 58.3 | 14.7 | 16.8* | 4.5* | 0.53 | 0.01 | 4.76 | 0.004 | |
| 25 | 0.015 | 0.01 | 0.02 | 0.001 | 0.001 | 55.2 | 18.6 | 11.8 | 6.7 | 0.61 | 2.34* | 4.59 | 0.062* | |
| 26 | 0.002 | 0.01 | 0.01 | 0.001 | 0.001 | 57.6 | 15.2 | 13.4 | 7.2 | 0.01 | 0.12 | 6.42* | 0.003 | |
| 27 | 0.006 | 0.02 | 1.38* | 0.002 | 0.001 | 51.8 | 18.7 | 12.9 | 10 | 1.21* | 0.21 | 3.78* | 0.001 | |

Note: *Outside the range of the present invention.

TABLE 2

| No | Heat Treatment | Aging | Mechanical Properties: 0.2% Off set Yield Strength (kgf/mm²) | Tensile Strength (kgf/mm²) | Elongation (%) | Reduction in Area (%) | Impact Strength (kgf m/cm²) | Corrosion Resistance: SCC | Hydrogen Embrittlement | Remarks |
|---|---|---|---|---|---|---|---|---|---|---|
| 1 | 1075° C. × 1 h, WQ | 700° C. × 20 h, AC | 84 | 120 | 38 | 61 | 14 | ○ | ○ | Invention |
| 2 | " | " | 85 | 119 | 37 | 59 | 13 | ○ | ○ | Alloys |
| 3 | " | " | 86 | 120 | 36 | 53 | 8.8 | ○ | ○ | |
| 4 | " | " | 79 | 118 | 39 | 56 | 17 | ○ | ○ | |
| 5 | " | " | 82 | 116 | 32 | 52 | 8.1 | ○ | ○ | |
| 6 | " | " | 85 | 121 | 30 | 51 | 10 | ○ | ○ | |
| 7 | " | " | 96 | 132 | 25 | 41 | — | ○ | ○ | |
| 8 | " | " | 85 | 117 | 33 | 50 | — | ○ | ○ | |
| 9 | " | 725° C. × 4 h FC → 625° C. × 12 h, AC | 88 | 119 | 30 | 49 | — | ○ | ○ | |
| 10 | " | 725° C. × 4 h FC → 625° C. × 12 h, AC | 85 | 117 | 37 | 56 | — | ○ | ○ | |
| 11 | " | 725° C. × 4 h FC → 625° C. × 12 h, AC | 81 | 116 | 32 | 50 | — | ○ | ○ | |
| 12 | " | 725° C. × 4 h FC → 625° C. × 12 h, AC | 84 | 116 | 29 | 47 | — | ○ | ○ | |
| 13 | " | 700° C. × 20 h, AC | 79 | 113 | 39 | 60 | — | ○ | ○ | |
| 14 | " | 725° C. × 4 h FC → 625° C. × 12 h, AC | 95 | 130 | 20 | 41 | — | ○ | ○ | |
| 15 | " | 725° C. × 4 h FC → 625° C. × 12 h, AC | 86 | 121 | 25 | 46 | — | ○ | ○ | |
| 16 | " | 725° C. × 4 h FC → 625° C. × 12 h, AC | 87 | 126 | 23 | 42 | — | ○ | ○ | |
| 17 | 1075° C. × 1 h, WQ | 700° C. × 20 h, AC | 56 | 98 | 45 | 68 | — | X | X | Com- |
| 18 | " | " | 93 | 124 | 29 | 50 | — | X | X | para- |

TABLE 2-continued

| No | Heat Treatment | Aging | Mechanical Properties: 0.2% Off set Yield Strength (kgf/mm²) | Tensile Strength (kgf/mm²) | Elongation (%) | Reduction in Area (%) | Impact Strength (kgf m/cm²) | Corrosion Resistance: SCC | Hydrogen Embrittlement | Remarks |
|---|---|---|---|---|---|---|---|---|---|---|
| 19 | " | " | 69 | 104 | 28 | 52 | — | X | X | tive |
| 20 | 1100° C. × 1 h, WQ | " | 81 | 125 | 7 | 15 | — | X | X | Alloys |
| 21 | " | " | 83 | 120 | 14 | 20 | — | X | X | |
| 22 | " | " | 81 | 119 | 15 | 23 | — | X | X | |
| 23 | " | " | 76 | 123 | 17 | 26 | — | ○ | X | |
| 24 | " | " | 72 | 120 | 10 | 15 | — | X | X | |
| 25 | " | " | 82 | 126 | 23 | 31 | — | ○ | X | |
| 26 | " | " | 98 | 136 | 7 | 12 | — | X | X | |
| 27 | " | " | 81 | 123 | 18 | 27 | — | X | X | |

TABLE 3

| No. | Chemical Composition (% by weight): C | Si | Mn | P | S | Ni | Cr | Mo | Fe | Ti | Al | Nb | N | Co | Others | Remarks |
|---|---|---|---|---|---|---|---|---|---|---|---|---|---|---|---|---|
| 1 | 0.007 | 0.01 | 0.01 | 0.002 | 0.001 | 54.4 | 20.2 | 7.6 | 12.6 | <0.01 | 0.11 | 4.96 | 0.001 | — | | Invention |
| 2 | 0.018 | 0.06 | 0.10 | 0.015 | 0.001 | 51.2 | 17.9 | 8.3 | 16.0 | <0.01 | 0.34 | 4.72 | 0.002 | 1.3 | | Alloys |
| 3 | 0.002 | 0.31 | 0.01 | 0.002 | 0.002 | 58.5 | 23.0 | 6.1 | 7.3 | <0.01 | 0.20 | 4.52 | 0.014 | — | Mg:0.002 | |
| 4 | 0.032 | 0.01 | 0.01 | 0.001 | 0.003 | 52.3 | 15.4 | 8.8 | 18.4 | 0.05 | 0.21 | 4.73 | 0.003 | — | | |
| 5 | 0.004 | 0.07 | 0.11 | 0.001 | 0.001 | 55.7 | 14.9 | 8.1 | 15.8 | <0.01 | 0.13 | 5.18 | 0.002 | — | | |
| 6 | 0.007 | 0.05 | 0.30 | 0.018 | 0.001 | 50.3 | 15.1 | 7.9 | 20.0 | 0.03 | 0.08 | 4.77 | 0.002 | — | Cu:0.46 | |
| 7 | 0.008 | 0.01 | 0.01 | 0.001 | 0.001 | 51.6 | 18.2 | 6.8 | 18.1 | <0.01 | 0.47 | 4.75 | 0.002 | — | La:0.001 | |
| 8 | 0.008 | 0.01 | 0.01 | 0.002 | 0.002 | 52.9 | 14.7 | 8.5 | 16.7 | 0.05 | 0.95 | 4.96 | 0.021 | 1.2 | Ce:0.001, Mg:0.002 | |
| 9 | 0.010 | 0.02 | 0.01 | 0.001 | 0.001 | 58.6 | 18.6 | 6.9 | 9.6 | <0.01 | 0.78 | 5.39 | 0.002 | — | | |
| 10 | 0.002 | 0.01 | 0.31 | 0.001 | 0.001 | 47.2 | 15.1 | 7.5 | 22.5 | 0.56 | 1.02 | 5.75 | 0.002 | — | Y:0.001, Ca:0.002 | |
| 11 | 0.002 | 0.05 | 0.30 | 0.002 | 0.005 | 50.3 | 19.0 | 3.1* | 20.7 | 1.06* | 0.42 | 5.10 | 0.002 | — | | Comparative |
| 12 | 0.003 | 0.01 | 0.01 | 0.002 | 0.001 | 42.1* | 21.8 | 3.0* | 28.0* | 2.4* | 0.30 | <0.001* | 0.002 | — | Cu:2.35* | Alloys |

Note: *Outside the range of the present invention.

TABLE 4

| No. | Heat Treatment | Aging | Mechanical Properties: 0.2% Off Set Yield Strength (kgf/mm²) | Tensile Strength (kgf/mm²) | Elongation (%) | Reduction in Area (%) | Corrosion Resistance: SCC | Hydrogen Embrittlement | Remarks |
|---|---|---|---|---|---|---|---|---|---|
| 1 | 1075° C. × 1 h, WQ | 725° C. × 4 h $\xrightarrow{FC}$ 625° C. × 12 h, AC | 93 | 121 | 33 | 54 | ○ | ○ | Invention Alloys |
| 2 | " | 725° C. × 4 h $\xrightarrow{FC}$ 625° C. × 12 h, AC | 88 | 120 | 30 | 57 | ○ | ○ | |
| 3 | " | 725° C. × 4 h $\xrightarrow{FC}$ 625° C. × 12 h, AC | 82 | 116 | 39 | 61 | ○ | ○ | |
| 4 | " | 725° C. × 4 h $\xrightarrow{FC}$ 625° C. × 12 h, AC | 91 | 123 | 32 | 54 | ○ | ○ | |
| 5 | " | 725° C. × 4 h $\xrightarrow{FC}$ 625° C. × 12 h, AC | 98 | 127 | 30 | 50 | ○ | ○ | |
| 6 | " | 725° C. × 4 h $\xrightarrow{FC}$ 625° C. × 12 h, AC | 90 | 119 | 33 | 51 | ○ | ○ | |
| 7 | " | 725° C. × 4 h $\xrightarrow{FC}$ 625° C. × 12 h, AC | 90 | 121 | 27 | 49 | ○ | ○ | |
| 8 | " | 700° C. × 20 h, AC | 84 | 112 | 36 | 52 | ○ | ○ | |
| 9 | " | " | 87 | 116 | 44 | 61 | ○ | ○ | |
| 10 | " | " | 92 | 118 | 31 | 58 | ○ | ○ | |
| 11 | " | " | 93 | 124 | 29 | 50 | X | X | Comparative |
| 12 | " | " | 69 | 104 | 28 | 52 | X | X | |

TABLE 4-continued

| No. | Heat Treatment | Aging | Mechanical Properties: 0.2% Off Set Yield Strength (kgf/mm²) | Tensile Strength (kgf/mm²) | Elongation (%) | Reduction in Area (%) | Corrosion Resistance: SCC | Hydrogen Embrittlement | Remarks |
|---|---|---|---|---|---|---|---|---|---|
| | | | | | | | | | Alloys |

TABLE 5

| No | Chemical composition (% by weight): C | Si | Mn | P | S | Ni | Cr | Mo | Fe | Ti | Al | Nb | N | Ni-2 {Mo + 1.5(Cr-12)}-4{Nb + 1.5 Ti + (Al-0.5)/2} |
|---|---|---|---|---|---|---|---|---|---|---|---|---|---|---|
| 1 | 0.006 | <0.01 | 0.01 | 0.001 | <0.001 | 58.31 | 15.07 | 12.47 | 8.33 | 0.67 | 0.13 | 4.99 | 0.0006 | 0.92 |
| 2 | 0.002 | 0.03 | 0.01 | 0.002 | 0.001 | 56.02 | 14.76 | 10.86 | 12.49 | 0.54 | 0.56 | 4.72 | 0.0020 | 3.78 |
| 3 | 0.003 | 0.02 | 0.01 | 0.001 | 0.001 | 53.99 | 14.98 | 11.53 | 14.20 | 0.91 | 0.12 | 4.23 | 0.0012 | 0.37 |
| 4 | 0.003 | 0.12 | 0.01 | 0.002 | 0.001 | 59.87 | 19.82 | 9.64 | 5.42 | 0.98 | 0.12 | 4.01 | 0.0010 | 7.43 |
| 5 | 0.012 | 0.08 | 0.01 | 0.001 | 0.002 | 59.43 | 15.61 | 11.49 | 6.01 | 0.59 | 1.21 | 4.06 | 0.0007 | 1.04 |
| 6 | 0.007 | 0.02 | 0.01 | 0.001 | 0.001 | 59.05 | 14.58 | 13.90 | 6.00 | 0.56 | 0.14 | 5.12 | 0.0008 | 0.39 |
| 7 | 0.002 | 0.01 | 0.30 | 0.001 | 0.002 | 58.17 | 19.42 | 9.59 | 5.06 | 0.52 | 0.11 | 4.05 | 0.0009 | 0.02 |
| 8 | 0.005 | 0.01 | 0.29 | 0.001 | 0.001 | 57.38 | 15.63 | 11.28 | 11.50 | 0.78 | 0.13 | 4.98 | 0.0015 | 0.07 |
| 9 | 0.006 | 0.01 | 0.33 | 0.001 | 0.001 | 58.84 | 15.33 | 11.85 | 7.54 | 0.62 | 0.15 | 5.32 | 0.0011 | 0.85 |
| 10 | 0.002 | 0.01 | 0.88 | 0.001 | 0.001 | 57.76 | 14.80 | 11.54 | 8.39 | 0.95 | 0.88 | 4.78 | 0.0008 | 0.70 |
| 11 | 0.005 | 0.30 | 0.01 | 0.005 | 0.001 | 59.47 | 15.02 | 13.45 | 5.89 | 0.82 | 0.13 | 4.70 | 0.0009 | 0.53 |
| 12 | 0.003 | 0.31 | 0.01 | 0.001 | 0.001 | 58.88 | 14.03 | 15.29 | 6.50 | 0.93 | 0.12 | 4.22 | 0.0019 | 0.51 |

TABLE 6

| No | Heat Treatment | Aging | Mechanical properties: 0.2% off-set yield strength (kgf/mm²) | Tensile strength (kgf/mm²) | Elongation (%) | Reduction in area (%) | Impact value (kgfm/cm²) | Corrosion resistance: SCC | Hydrogen embrittlement |
|---|---|---|---|---|---|---|---|---|---|
| 1 | 1060° C. × 2 h, WQ | 725° C. × 3 h, AC | 110 | 138 | 30 | 50 | 9.0 | ○ | ○ |
| 2 | 1060° C. × 2 h, WQ | 725° C. × 3 h, AC | 106 | 132 | 27 | 41 | 9.1 | ○ | ○ |
| 3 | 1060° C. × 2 h, WQ | 720° C. × 20 h, AC | 100 | 130 | 35 | 47 | 8.9 | ○ | ○ |
| 4 | 1060° C. × 2 h, WQ | 720° C. × 20 h, AC | 97 | 129 | 39 | 49 | 10 | ○ | ○ |
| 5 | 1065° C. × 4 h, AC | 700° C. × 8 h, FC + 620° C. × 8 h, AC | 93 | 120 | 39 | 58 | 11 | ○ | ○ |
| 6 | 1065° C. × 4 h, AC | 725° C. × 10 h, AC | 103 | 137 | 27 | 43 | 7.9 | ○ | ○ |
| 7 | 1080° C. × 0.5 h, AC | 700° C. × 8 h, FC + 620° C. × 8 h, AC | 92 | 118 | 38 | 59 | 14 | ○ | ○ |
| 8 | 1080° C. × 0.5 h, AC | 700° C. × 8 h, FC + 620° C. × 8 h, AC | 97 | 123 | 40 | 54 | 11 | ○ | ○ |
| 9 | 1060° C. × 4 h, WQ | 720° C. × 15 h, AC | 113 | 141 | 28 | 43 | 8.5 | ○ | ○ |
| 10 | 1060° C. × 4 h, WQ | 720° C. × 15 h, AC | 101 | 133 | 38 | 47 | 10 | ○ | ○ |
| 11 | 1060° C. × 4 h, WQ | 720° C. × 15 h, AC | 104 | 129 | 33 | 44 | 9.7 | ○ | ○ |
| 12 | 1060° C. × 4 h, WQ | 720° C. × 15 h, AC | 105 | 131 | 31 | 42 | 9.5 | ○ | ○ |

What is claimed is:

1. A precipitation-hardenable Ni-base alloy exhibiting improved resistance to stress corrosion cracking in a sour gas atmosphere containing elemental sulfur at high temperatures, consisting essentially of, by weight %;

| | | | |
|---|---|---|---|
| Cr: | 12–22%, | Mo: | 9–15% |
| Nb: | 4.0–6.0%, | Fe: | 5–20%, |
| Ni: | 50–60%, | C: | 0.050% or less, |
| Si: | 0.50% or less, | Mn: | 1.0% or less, |
| P: | 0.025% or less, | S: | 0.0050% or less, |
| N: | 0.050% or less, | | |
| Ti: | 0.46–1.0% | Al: | 0–2.0%, and |

$$Ni - 2\{Mo + 1.5(Cr - 12)\} - 4\{Nb + 1.5\,Ti + 0.5(Al - 0.5)\} \leqq 0.$$

2. The precipitation-hardenable Ni-base alloy defined in claim 1, wherein the alloy includes over 9.0% Mo.

3. The precipitation-hardenable Ni-base alloy defined in claim 1, wherein the alloy includes 10.6%–15% Mo.

4. The precipitation-hardening Ni-base alloy defined in claim 1, in which Al:0.1%–2.0%.

5. The precipitation-hardening Ni-base alloy defined in claim 1, in which Al:0.01%–2.0%.

6. The precipitation-hardening Ni-base alloy defined in claim 1, in which N:≦0.002.

7. The precipitation-hardening Ni-base alloy defined in claim 1, in which Nb≧4.2%.

8. The precipitation-hardenable Ni-base alloy defined in claim 1, in which Nb and Ti are present in amounts which minimize precipitation of $\gamma'$ $Ni_3(Ti,Al)$ to improve resistance to SCC and hydrogen embrittlement and promote precipitation of $\gamma''$ $Ni_3Nb$ to improve strength and resistance to corrosion.

9. A method of improving the resistance of tubular products for oil wells to stress corrosion cracking in a sour gas atmosphere containing elemental sulfur at high temperature by fabricating the products from a precipitation-hardenable Ni-base alloy consisting essentially of, by weight %;

10. The method defined in claim 8, wherein the alloy includes over 9.0% Mo.

11. The method defined in claim 9, in which the sour gas atmosphere contains elemental sulfur at a temperature 200°–250° C., the alloy composition consisting essentially of, by weight %,

| | |
|---|---|
| Cr: 12–22%, | Mo: over 9.0 and up to 15%, |

-continued

| | |
|---|---|
| Nb: 4.0–6.0%, | Fe: 5.0–20%, |
| Ni: 50–60%, | C: 0.050% or less, |
| Si: 0.50% or less, | Mn: 1.0% or less, |
| P: 0.025% or less, | S: 0.0050% or less, |
| N: 0.050% or less, | |
| Ti: 0.46–1.0%, | Al: 0–2.0%. |

12. The method defined in claim 8, wherein the alloy includes 10.6%–15% Mo.

13. The method defined in claim 9, in which Al:0.0-1%–2.0%.

14. The method defined in claim 9, in which the tubular products are selected from the members for fabricating oil well outlet assemblies, and oil well bottom casings.

15. The method defined in claim 9, in which N:≦0.002.

* * * * *